US008511206B2

(12) United States Patent
Hong

(10) Patent No.: US 8,511,206 B2
(45) Date of Patent: Aug. 20, 2013

(54) RATCHET WRENCH WITH ROTATABLE DRIVING HEAD

(76) Inventor: Ming-Nan Hong, Taichung (TW)

( * ) Notice: Subject to any disclaimer, the term of this patent is extended or adjusted under 35 U.S.C. 154(b) by 204 days.

(21) Appl. No.: 13/231,982

(22) Filed: Sep. 14, 2011

(65) Prior Publication Data

US 2013/0061720 A1 Mar. 14, 2013

(51) Int. Cl.
*B25B 13/52* (2006.01)
*B25B 23/16* (2006.01)

(52) U.S. Cl.
USPC ..... 81/60; 81/61; 81/62; 81/177.8

(58) Field of Classification Search
USPC ..... 81/60, 177.6, 177.7, 177.9, 177.8
See application file for complete search history.

(56) References Cited

U.S. PATENT DOCUMENTS

| | | | | |
|---|---|---|---|---|
| 1,320,137 | A * | 10/1919 | Gunn | 81/62 |
| 1,331,956 | A * | 2/1920 | Cross | 81/60 |
| 7,246,544 | B1 * | 7/2007 | Lee | 81/177.8 |
| 7,975,575 | B2 * | 7/2011 | Hu | 81/177.8 |
| 2006/0201288 | A1 * | 9/2006 | Chen | 81/177.8 |

* cited by examiner

*Primary Examiner* — Monica Carter
*Assistant Examiner* — Danny Hong

(57) ABSTRACT

A ratchet wrench includes a body, a driving head, a control member and a resilient member. The body includes a handle and a Y-shaped extension. The driving head is pivotably connected to the Y-shaped extension by two pivots and an inner groove and a recess are respectively defined in the inside of the Y-shaped extension. The inner groove accommodates the C-shaped plate of the control member and the resilient member is received in the recess. The C-shaped plate has engaging teeth defined in distal ends thereof and the pivots each have ratchet teeth which are engaged with the engaging teeth by moving the control member so as to control the rotation of the driving head relative to the body.

10 Claims, 12 Drawing Sheets

RATCHET WRENCH WITH ROTATABLE DRIVING HEAD

FIELD OF THE INVENTION

The present invention relates to a ratchet wrench, and more particularly, to a ratchet wrench whose driving head is rotatable relative to the handle.

BACKGROUND OF THE INVENTION

A conventional ratchet wrench is disclosed in U.S. Pat. No. 2,977,824 and generally includes a driving head and a handle which is pivotably connected to the driving head, and a slot is defined in the handle so that a locking pin is engaged with the slot to secure the Y-shaped extension. The advantage is that when a socket is connected with the driving head, the locking pin is rotated to control the driving head to be rotatable over 270 degrees relative to the handle. However, there are two disadvantages which are that the engaging portion of the driving head protrudes out from the driving head so that when rotating the driving head, the engaging portion is stopped by the handle so that the driving head cannot be rotated 360 degrees relative to the handle. Besides, there is no positioning device on the engaging portion so that the socket cannot be firmly connected to the engaging portion.

Although there are several driving head rotatable wrenches in the market, they are complicated and not satisfied by the users.

The present invention intends to provide a ratchet wrench whose driving head is conveniently rotatable relative to the handle and the ratchet wrench improves the shortcomings of the conventional ratchet wrenches.

SUMMARY OF THE INVENTION

The present invention relates to a ratchet wrench and comprises a body, a driving head, a control member and a resilient member. The body includes a handle and a Y-shaped extension. The driving head is pivotably connected to the Y-shaped extension by two pivots and an inner groove and a recess are respectively defined in the inside of the Y-shaped extension. The inner groove accommodates the C-shaped plate of the control member and the resilient member is received in the recess. The C-shaped plate has engaging teeth defined in distal ends thereof and the pivots each have ratchet teeth which are engaged with the engaging teeth by moving the control member so as to control the rotation of the driving head relative to the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
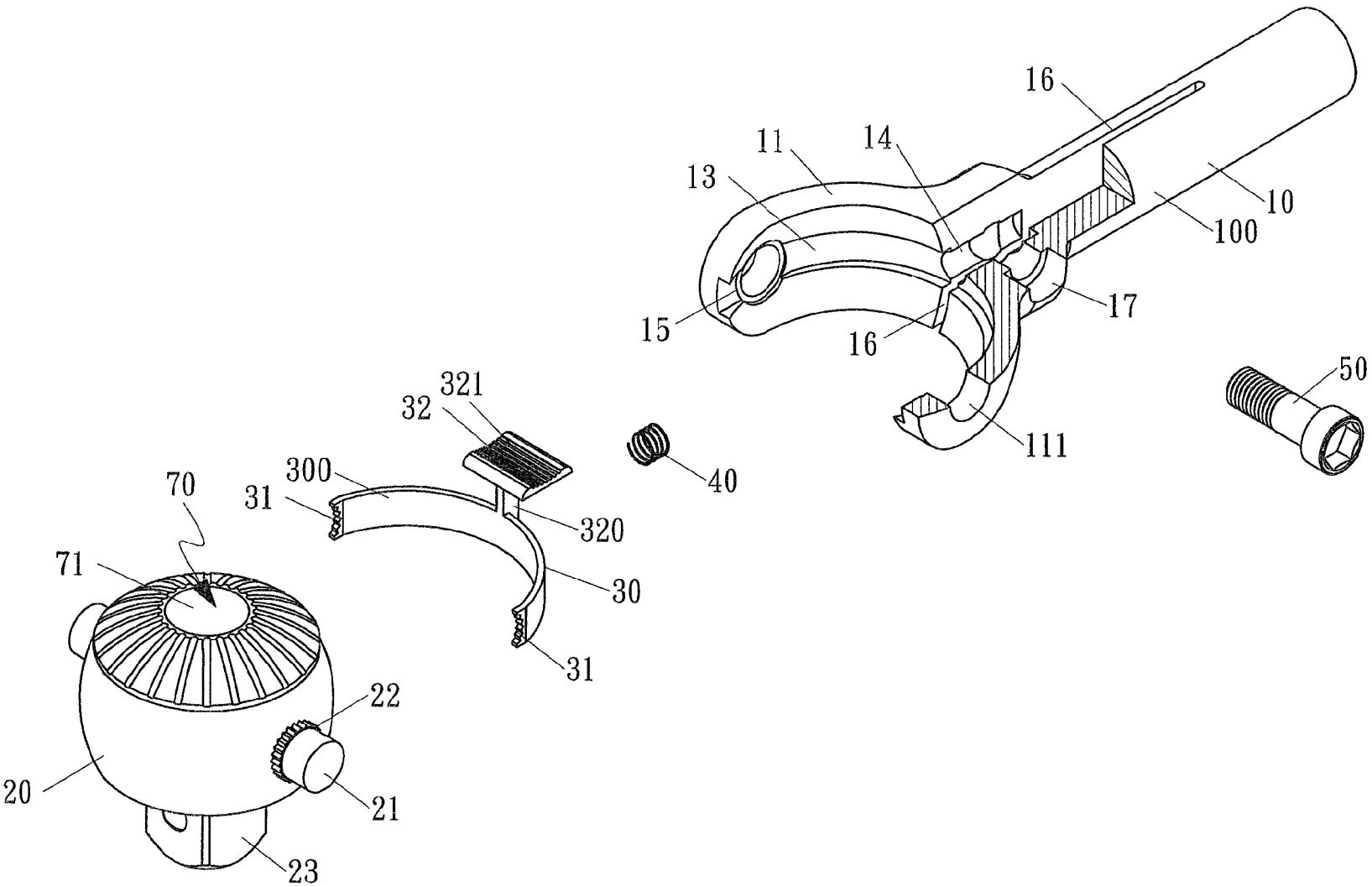
FIG. 1 is an exploded view to show the first embodiment of the ratchet wretch of the present invention.
Figure 2:
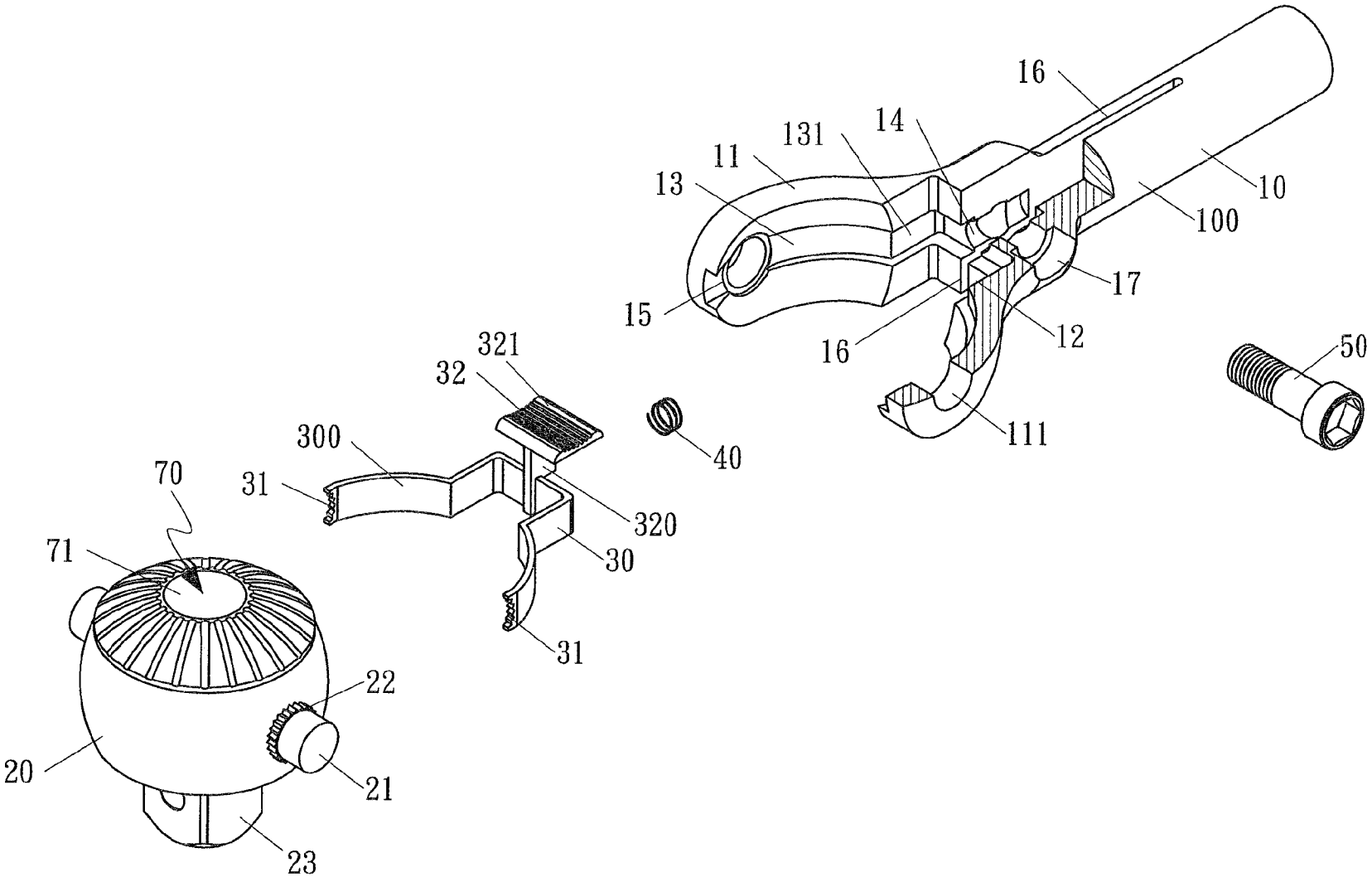
FIG. 2 is an exploded view to show the second embodiment of the ratchet wretch of the present invention.
Figure 3:
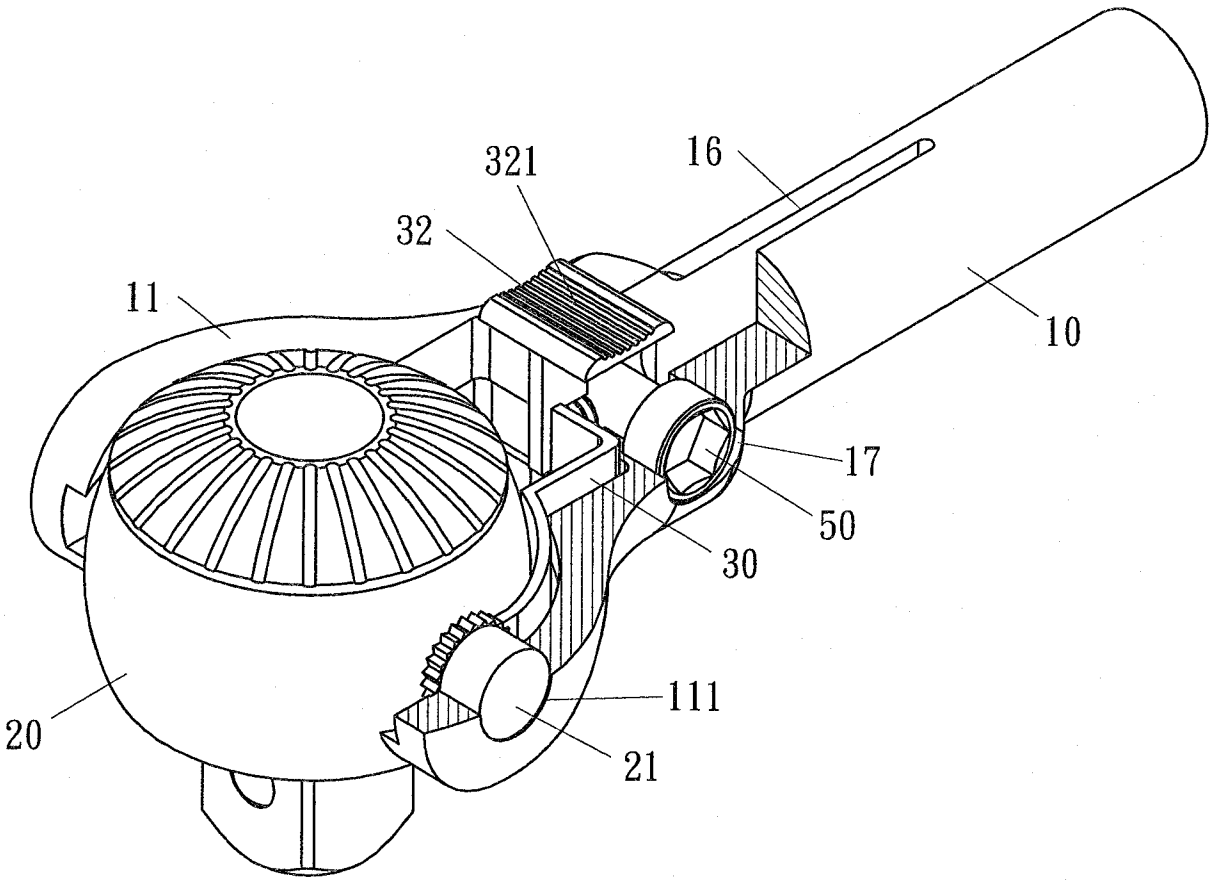
FIG. 3 is a partial cross sectional view of the second embodiment of the ratchet wretch of the present invention.
Figure 4:
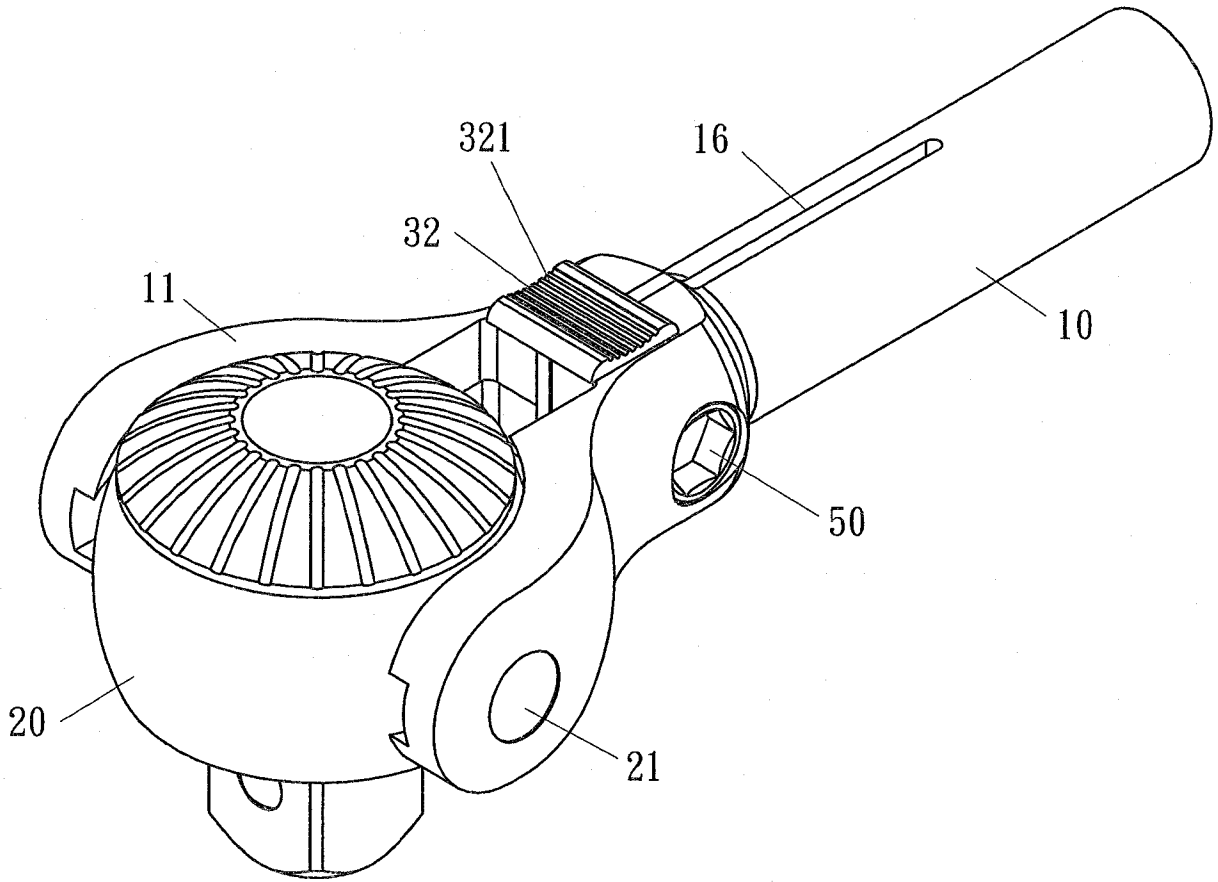
FIG. 4 is a perspective view of the second embodiment of the ratchet wretch of the present invention.
Figure 7:
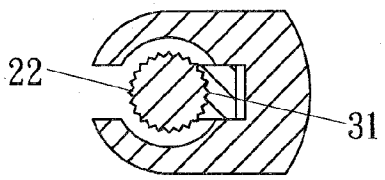
FIG. 7 is a cross sectional view, taken along line B-B in FIG. 5.
Figure 5:
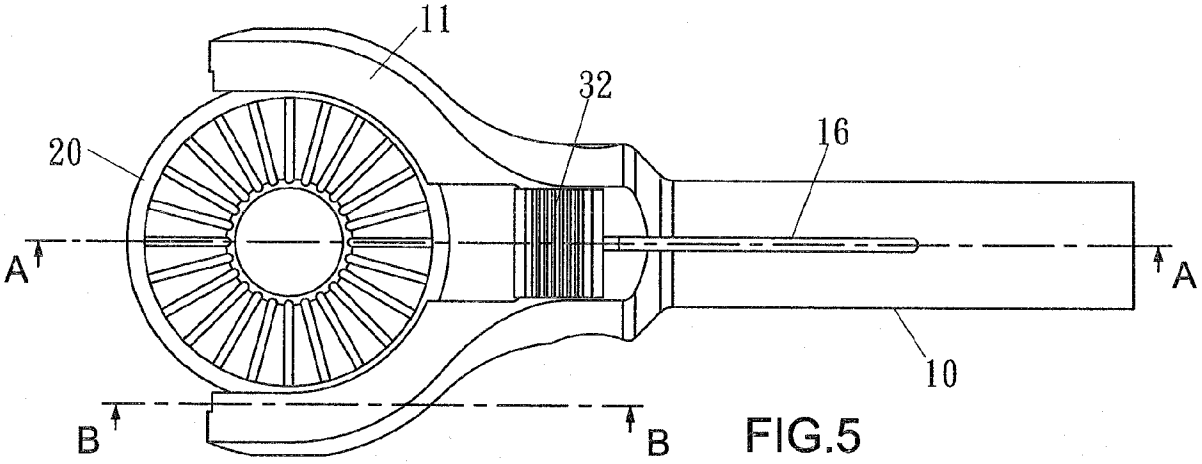
FIG. 5 is a top view of the second embodiment of the ratchet wretch of the present invention.
Figure 6:
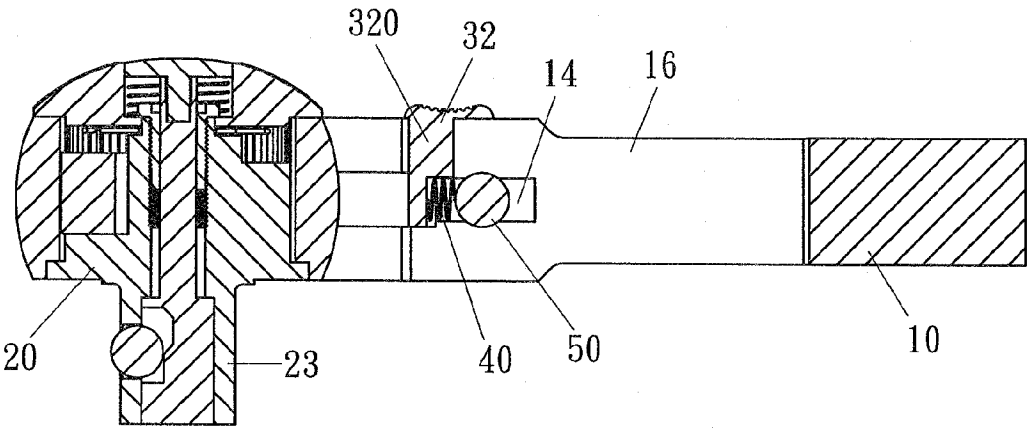
FIG. 6 is a cross sectional view, taken along line A-A in FIG. 5.
Figure 8:
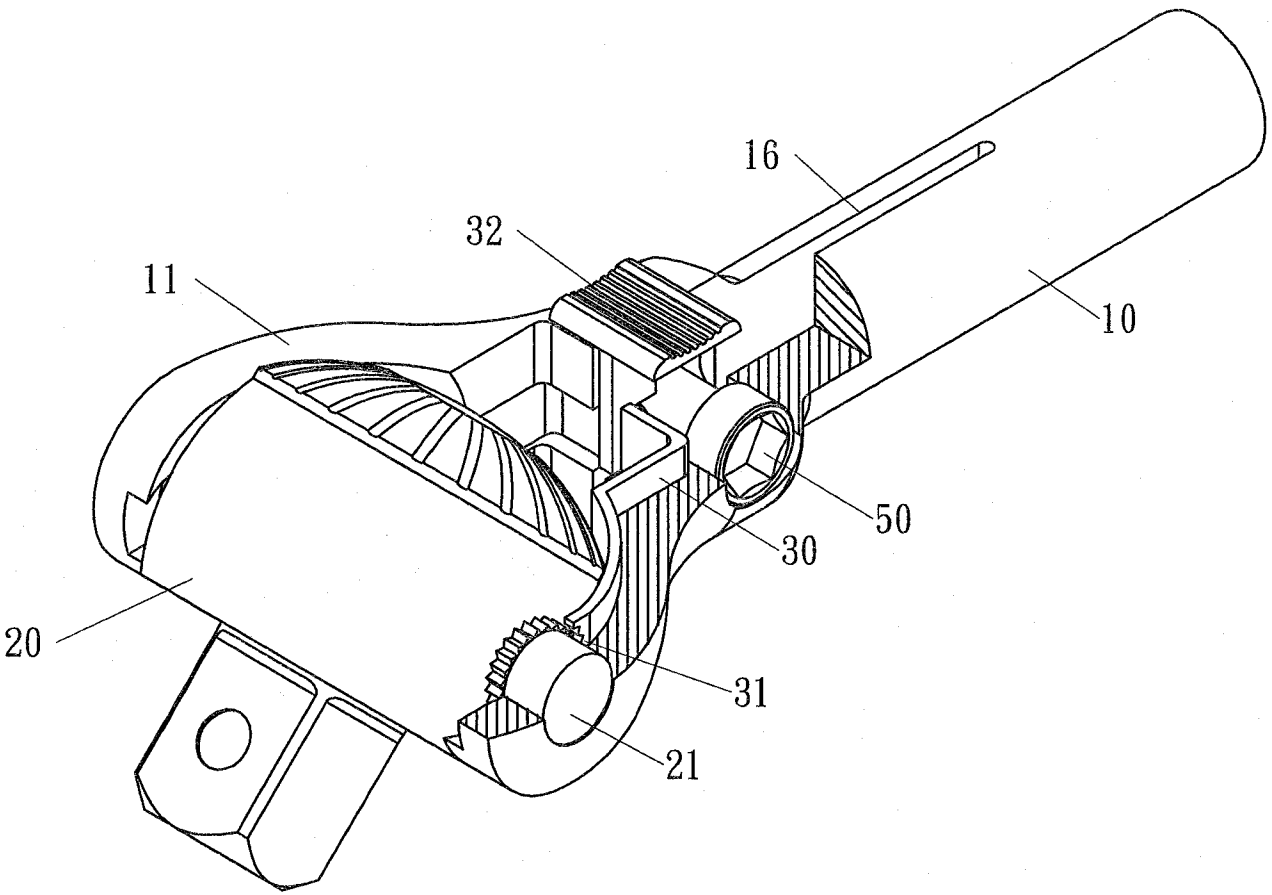
FIG. 8 shows the operational status of the second embodiment of the ratchet wretch of the present invention.

Referring to FIG. 1, the first embodiment of the ratchet wrench of the present invention comprises a body 10, a driving head 20, a control member 30 and a resilient member 40. The body 10 has a handle 100 extending from the rear end of the body 10 and a Y-shaped extension 11 is connected to the front end of the handle 100. Two pivotal holes 111 are respectively defined in two ends of the Y-shaped extension 11 and an inner groove 13 is defined in the inside of the U-shaped extension 11. A recess 14 is defined in the mediate portion of the Y-shaped extension 11 and extends along the handle 100. At least one slot 16 is defined in the inside of the recess 14 and communicates with outside of the handle 100. Two ends of the inner groove 13 communicate with the two pivotal holes 111 and the inner groove 13 communicates with the recess 14. The driving head 20 has a quick-release mechanism and can be rotated in two directions or one direction. The driving head 20 has two pivots 21 which are respectively and pivotably engaged with the pivotal holes 111 in the Y-shaped extension 11. The two pivots 21 each have ratchet teeth 22 defined in the outside thereof. The control member 30 has an integral C-shaped plate 300 and a first switch 32. The C-shaped plate 300 is engaged with the groove 13 and the first switch 30 is movable along the handle 100. The C-shaped plate 300 has engaging teeth 31 defined in the distal end thereof and the engaging teeth 31 are engaged with the ratchet teeth 22 of the driving head 20. A mediate section 320 of the first switch 32 extends through the at least one slot 16 and a distal end section 321 of the first switch 32 protrudes out form the handle 100. The resilient member 40 is received in the recess 14 and biases the C-shaped plate 300 so as to push the control member 30 toward the driving head 20 and to engage the engaging teeth 31 with the ratchet teeth 22.

Figure 9:
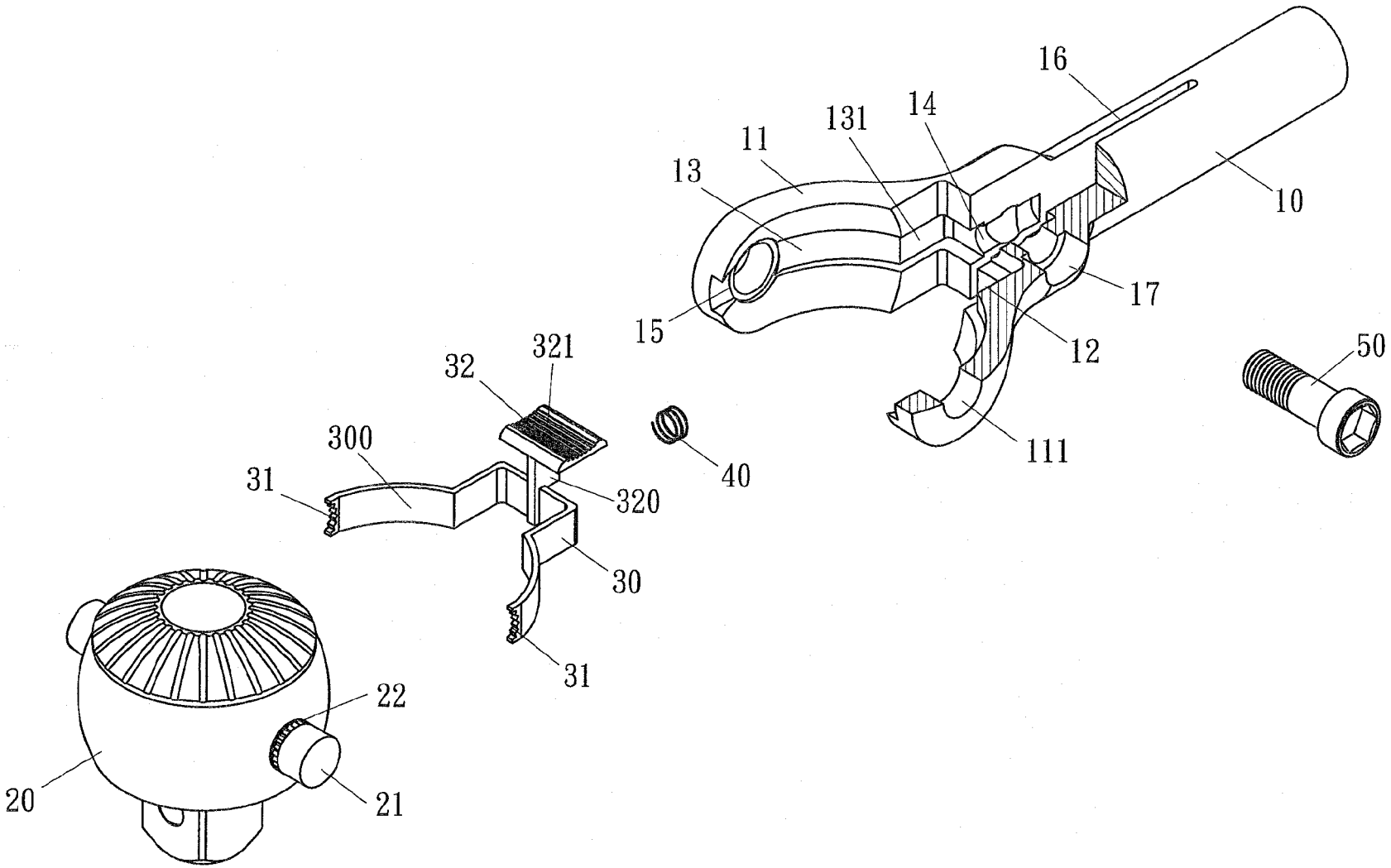
FIG. 9 shows another embodiment of the pivots with ratchet teeth.

As shown in FIG. 1, each of the pivotal holes 111 has an annular groove 15 whose diameter is larger than the diameter of the pivotal hole 111 corresponding thereto. The annular groove 15 communicates with the inner groove 13. The ratchet teeth 22 protrude out from the pivot 21 and are located in the annular groove 15. As shown in FIG. 9, the ratchet teeth 22 are defined in the outer surface of the pivots 21.

As shown in FIG. 1, the handle 100 has a threaded hole 17 which extends through the recess 14 and a bolt 50 threadedly extends through the threaded hole 17. The resilient member 40 is located between the bolt 50 and the C-shaped plate 300. There are two slots 16 defined in two facing walls of the recess 14.

As shown in FIGS. 2 to 8, the Y-shaped extension 11 has a recessed area 12 defined in the mediate portion thereof and the mediate section 131 of the inner groove 13 is concaved in the recessed area 12. The recess 14 is located at the central portion of the recessed area 12 and is a circular recess. The recessed area 12 is U-shaped recess with two parallel sides and the C-shaped plate 300 is shaped to be matched with the inner groove 13.

Figure 10:
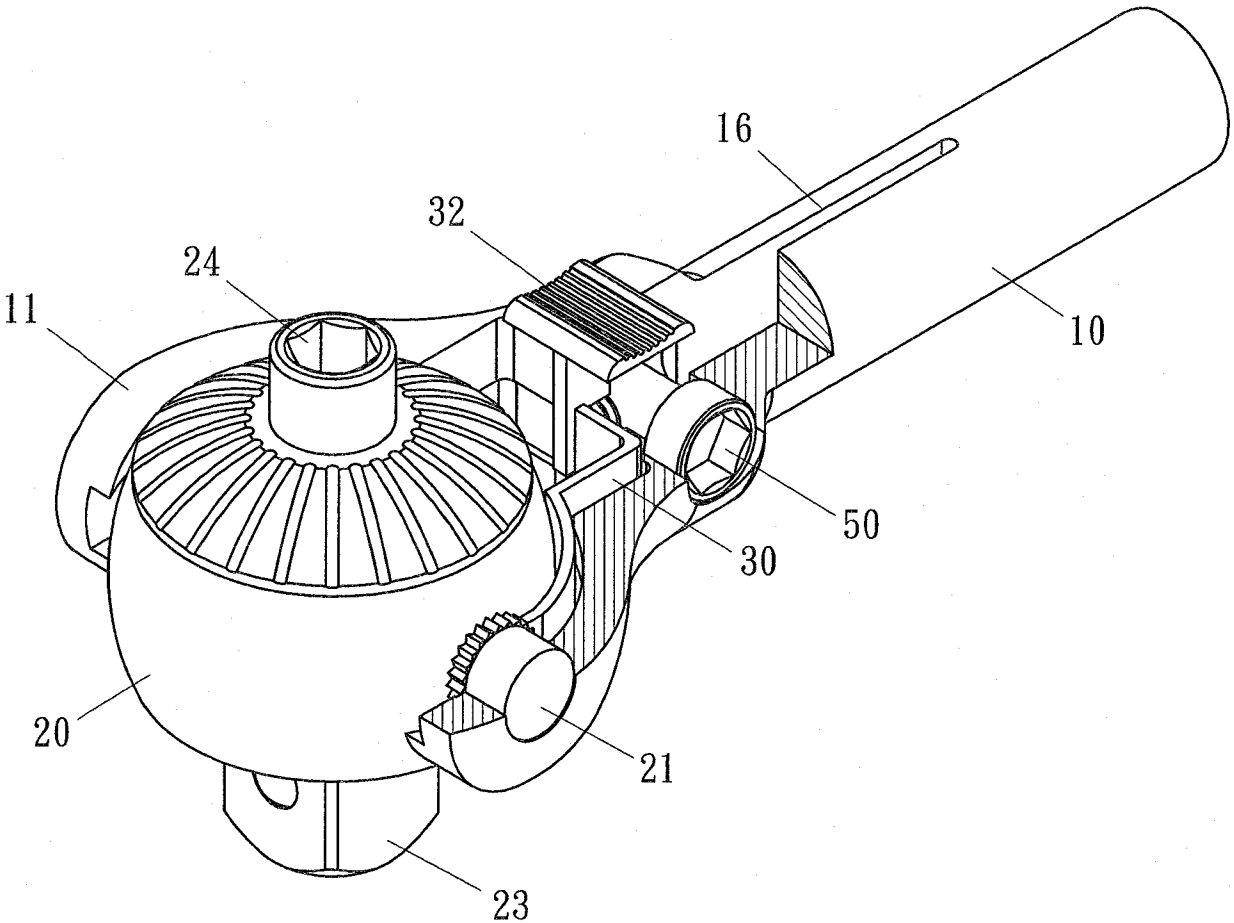
FIG. 10 shows another embodiment of the driving head of the ratchet wretch of the present invention.
Figure 11:
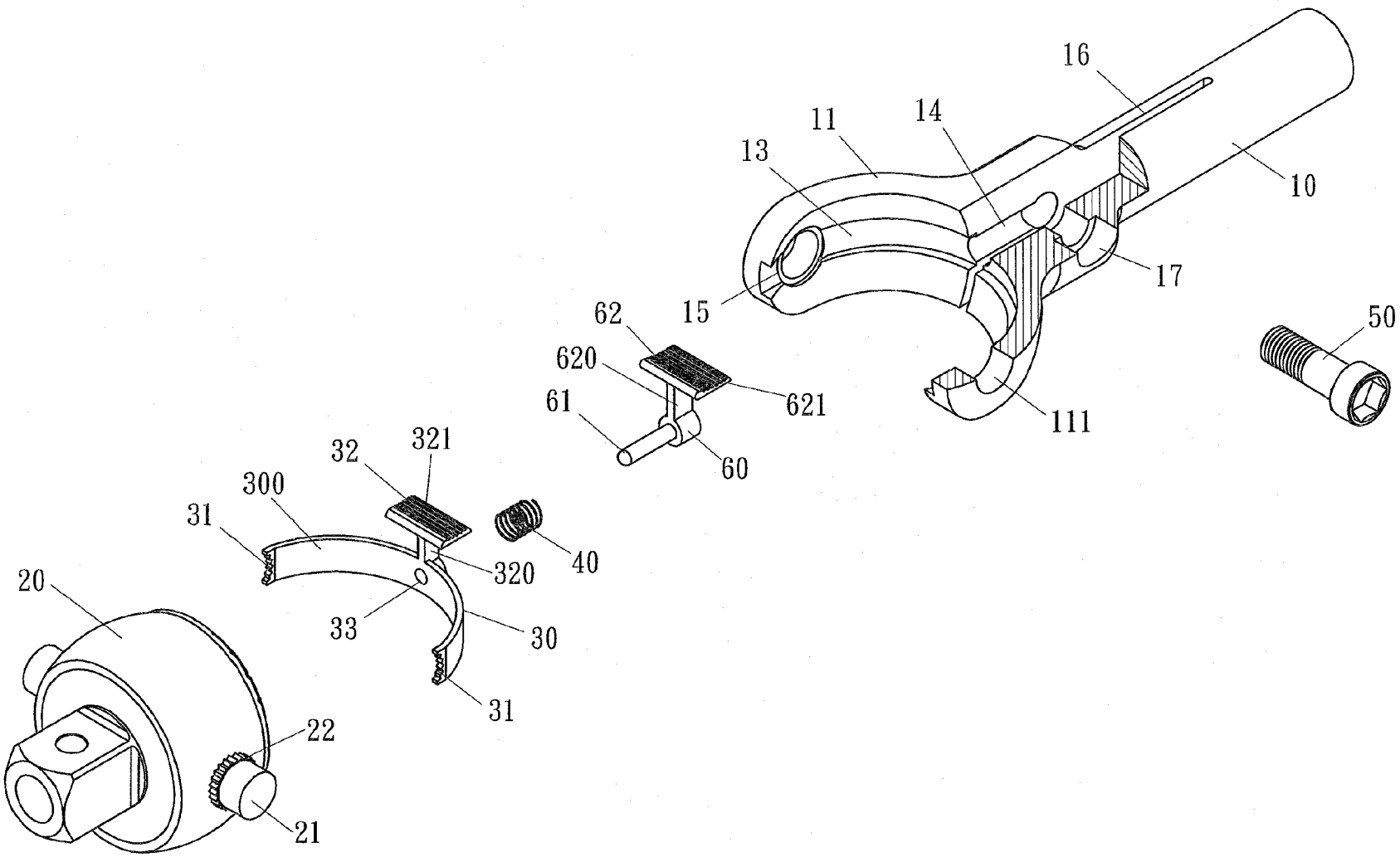
FIG. 11 is an exploded view to show the third embodiment of the ratchet wretch of the present invention.
Figure 12:
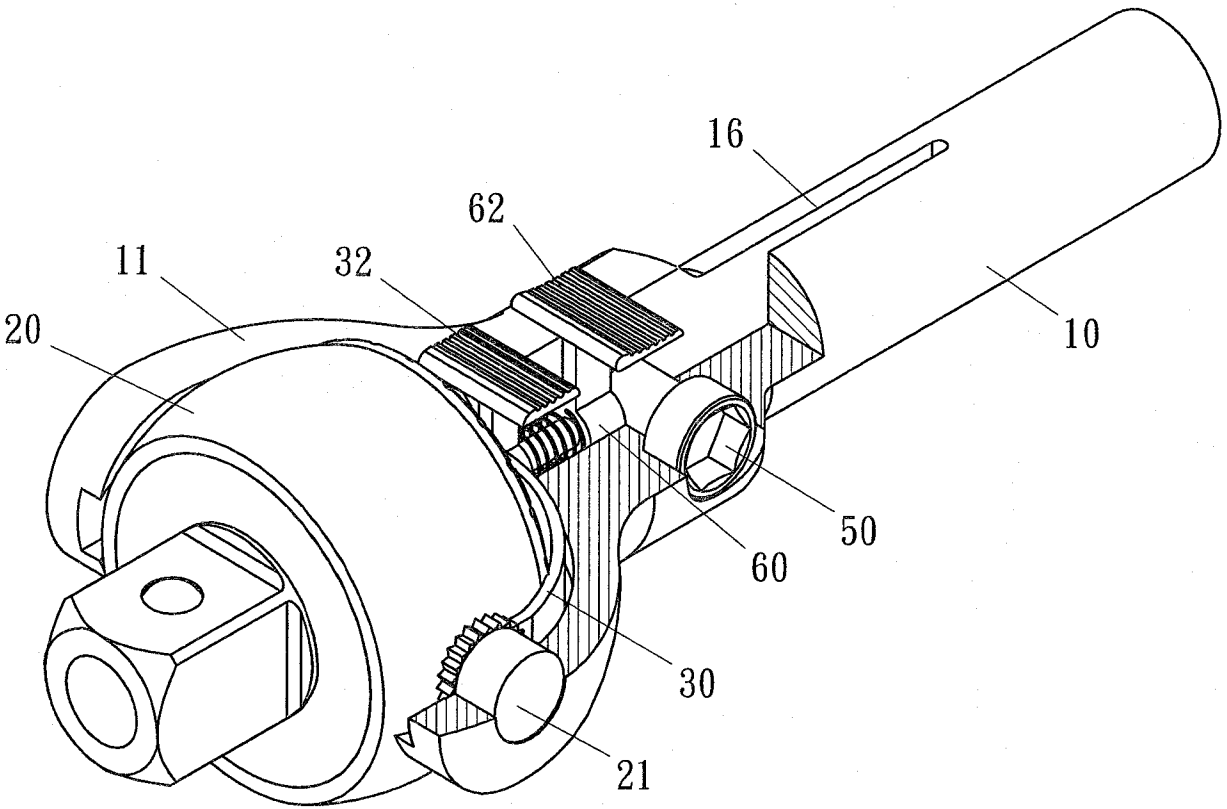
FIG. 12 is a cross sectional view of the third embodiment of the ratchet wretch of the present invention.

As shown in FIG. 10, in one embodiment, the driving head 20 includes two engaging portions 23, 24 respectively on two ends thereof. The engaging portion 23 is a quadrilateral rod and the engaging portion 24 is a hexagonal recess. The driving head 20 at least has an engaging portion on an end thereof and the engaging portion is used to be connected with a tool. When the driving head 20 is rotated 360 degrees relative to the Y-shaped extension 11, the engaging portion does not contact the body 10.

Figure 13:
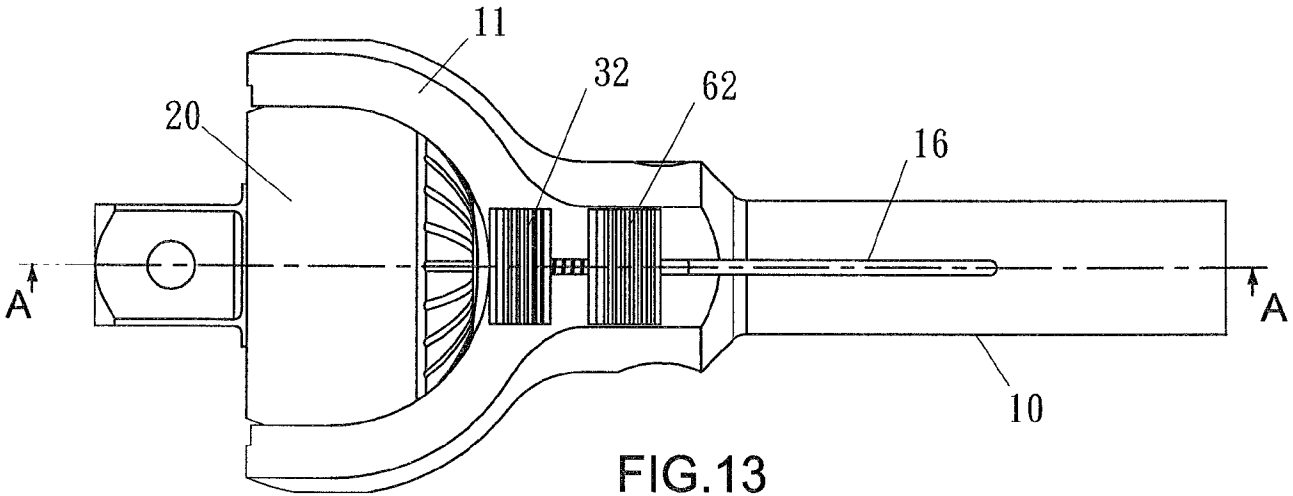
FIG. 13 is a top view of the third embodiment of the ratchet wretch of the present invention.
Figure 14:
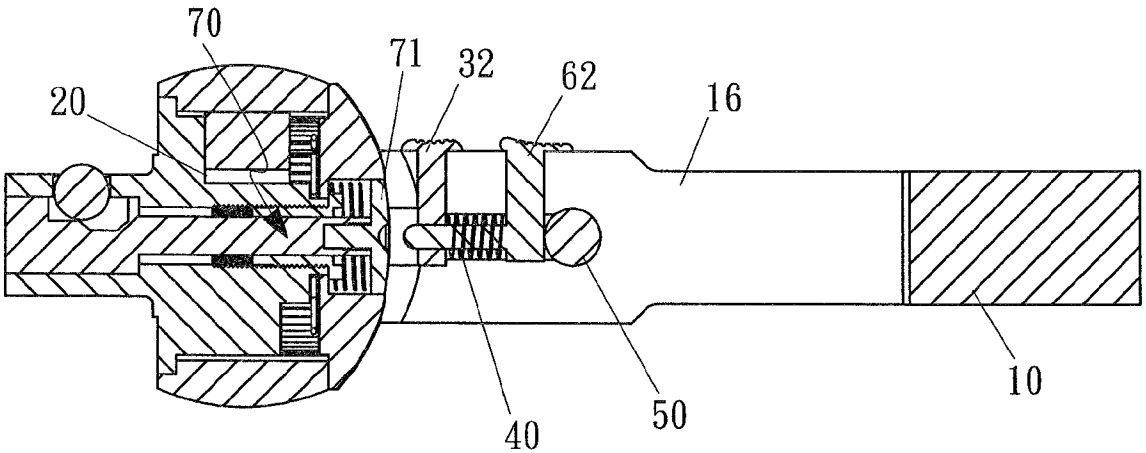
FIG. 14 is a cross sectional view, taken along line A-A in FIG. 13.
Figure 15:
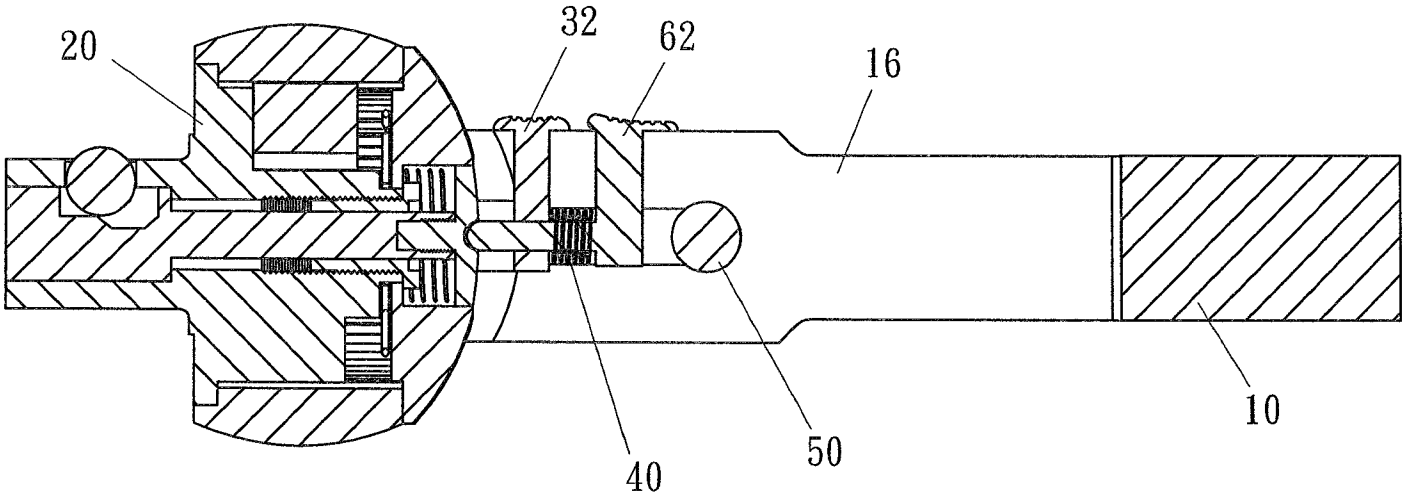
FIG. 15 is a cross sectional view of the operational status of the third embodiment of the ratchet wretch of the present invention.

As shown in FIGS. 11 to 15, the C-shaped plate 300 has a through hole 33 defined in the mediate portion thereof and the through hole is located corresponding to the recess 14. A push member 60 is located in the recess 14 and the front end of the push member 60 extends through the through hole 33. The resilient member 40 is located between the C-shaped plate 300 and the push member 60 which has a second switch 62 extending from a side thereof. A mediate section 620 of the second switch 62 extends through the at least one slot 16 and a rear end section 621 of the second switch 62 protrudes out from the handle 100. When a socket is connected with the driving head 20 as shown in FIG. 13, the button 71 of the quick release mechanism 70 is located at the mediate portion of the inside of the Y-shaped extension, so that when the push member 60 is moved, the front end 61 of the push member 60 presses the button 71 to release the socket from the engaging portion 23 of the driving head 20.

As shown in FIGS. 2 to 8, the user can push the first switch 32 to move the control member 30 toward the rear end of the handle 100, the C-shaped plate 300 presses the resilient member 40 and the engaging teeth 31 are disengaged from the ratchet teeth 22, so that the driving head 20 can be rotated about the pivots 21 for 360 degrees relative to the Y-shaped extension 11. When the driving head 20 is rotated to a desired position relative to the Y-shaped extension, the first switch 32 is released, the control member 30 is pushed by the resilient member 40, and then the engaging teeth 31 are engaged with the ratchet teeth 22 to position the driving head 20 relative to the body 10.

While we have shown and described the embodiment in accordance with the present invention, it should be clear to those skilled in the art that further embodiments may be made without departing from the scope of the present invention.

What is claimed is:

1. A ratchet wrench comprising:

a body having a handle extending from a rear end of the body and a Y-shaped extension connected to a front end of the handle, two pivotal holes respectively defined in two ends of the Y-shaped extension, an inner groove defined in an inside of the U-shaped extension, a recess defined in a mediate portion of the Y-shaped extension and extending along the handle, at least one slot defined in an inside of the recess and communicating with outside of the handle, two ends of the inner groove communicating with the two pivotal holes and the inner groove communicating with the recess;

a driving head having two pivots which are respectively pivotably engaged with the pivotal holes in the Y-shaped extension, the two pivots each having ratchet teeth defined in an outside thereof;

a control member having an integral C-shaped plate and a first switch, the C-shaped plate engaged with the groove and the first switch being movable along the handle, the C-shaped plate having engaging teeth defined in a distal end thereof and the engaging teeth engaged with the ratchet teeth of the driving head, a mediate section of the first switch extending through the at least one slot and a distal end section of the first switch protruding out form the handle, and a resilient member received in the recess and biasing the C-shaped plate so as to push the control member toward the driving head and to engage the engaging teeth with the ratchet teeth.

2. The ratchet wrench as claimed in claim 1, wherein each of the pivotal holes has an annular groove whose diameter is larger than a diameter of the pivotal hole corresponding thereto, the annular groove communicates with the inner groove, the ratchet teeth protrude out from the pivot and are located in the annular groove.

3. The ratchet wrench as claimed in claim 1, wherein the Y-shaped extension has a recessed area defined in a mediate portion thereof and the mediate section of the inner groove is concaved in the recessed area, the recess is located at the central portion of the recessed area and is a circular recess.

4. The ratchet wrench as claimed in claim 3, wherein the recessed area is U-shaped recess with two parallel sides.

5. The ratchet wrench as claimed in claim 1, wherein the C-shaped plate is shaped to be matched with the inner groove.

6. The ratchet wrench as claimed in claim 1, wherein the C-shaped plate has a through hole defined in a mediate portion thereof and the through hole is located corresponding to the recess, a push member is located in the recess and a front end of the push member extends through the through hole, the resilient member is located between the C-shaped plate and the push member which has a second switch extending from a side thereof, a mediate section of the second switch extends through the at least one slot and a rear end section of the second switch protrudes out from the handle.

7. The ratchet wrench as claimed in claim 1, wherein the driving head at least has an engaging portion on an end thereof and the engaging portion is adapted to be connected with a tool, when the driving head is rotated 360 degrees relative to the Y-shaped extension, the engaging portion does not contact the body.

8. The ratchet wrench as claimed in claim 7, wherein the driving head includes two engaging portions respectively on two ends thereof and one of the two engaging portions is a quadrilateral rod and the other engaging portion is a hexagonal recess.

9. The ratchet wrench as claimed in claim 1, wherein the handle has a threaded hole which extends through the recess, a bolt threadedly extends through the threaded hole, the resilient member is located between the bolt and the C-shaped plate.

10. The ratchet wrench as claimed in claim 1, wherein there are two slots defined in two facing walls of the recess.

* * * * *